US012241035B2

(12) United States Patent
Hughes et al.

(10) Patent No.: US 12,241,035 B2
(45) Date of Patent: Mar. 4, 2025

(54) FIRE STARTER KIT FOR FIREARM

(71) Applicant: NextLevel Training LLC, Ferndale, WA (US)

(72) Inventors: Michael Frank Hughes, Maple Falls, WA (US); Britton R Lentz, Everson, WA (US); Thomas Ryan Swetish, Bellingham, WA (US)

( * ) Notice: Subject to any disclaimer, the term of this patent is extended or adjusted under 35 U.S.C. 154(b) by 0 days.

(21) Appl. No.: 18/201,770

(22) Filed: May 25, 2023

(65) Prior Publication Data

US 2023/0392093 A1 Dec. 7, 2023

Related U.S. Application Data

(60) Provisional application No. 63/345,431, filed on May 25, 2022.

(51) Int. Cl.

| | |
|---|---|
| ***C10L 11/06*** | (2006.01) |
| ***C10L 5/44*** | (2006.01) |
| ***C10L 7/02*** | (2006.01) |
| ***C10L 11/04*** | (2006.01) |
| ***F23Q 1/06*** | (2006.01) |
| ***F23Q 2/18*** | (2006.01) |
| ***F41C 27/00*** | (2006.01) |

(52) U.S. Cl.

CPC ..... *C10L 11/06* (2013.01); *C10L 5/44* (2013.01); *C10L 5/442* (2013.01); *C10L 7/02* (2013.01); *C10L 11/04* (2013.01); *F23Q 1/06* (2013.01); *F23Q 2/18* (2013.01); *F41C 27/00* (2013.01); *C10L 2200/0213* (2013.01); *C10L 2200/0218* (2013.01); *C10L 2200/0222* (2013.01); *C10L 2200/024* (2013.01); *C10L 2200/0268* (2013.01); *C10L 2200/0453* (2013.01); *C10L 2230/06* (2013.01); *C10L 2270/08* (2013.01)

(58) Field of Classification Search

CPC ..... C10L 11/04; C10L 11/06; C10L 2200/0213; C10L 2200/0218; C10L 2200/0222; C10L 2200/024; C10L 2200/0268; C10L 2200/0453; C10L 2200/0469; C10L 2230/06; C10L 2270/08; C10L 5/368; C10L 5/44; C10L 5/442; C10L 7/02; F23Q 1/06; F23Q 2/18; F41C 27/00

See application file for complete search history.

(56) References Cited

U.S. PATENT DOCUMENTS

2003/0233779 A1* 12/2003 Graves ..... F41A 29/02 42/90
2010/0325933 A1* 12/2010 Huang ..... F41A 29/00 42/90
2011/0072705 A1* 3/2011 Simpkins ..... F41C 27/16 29/469
2015/0308686 A1* 10/2015 Hensley ..... F41A 29/02 42/90

* cited by examiner

*Primary Examiner* — Latosha Hines
(74) *Attorney, Agent, or Firm* — Michael Hughes

(57) ABSTRACT

A fire starter kit that includes a frame, a scratcher, a sparking road, and at least one fuel reservoir. The frame is having a first end, a second end, a middle region, a recess provided on the middle region, and a first slot provided along the first end, the second end and partially through the middle region. The scratcher removably mounted in the recess, wherein the scratcher is having at least one blade provided with a plurality of tooths. The sparking rod is removably mounted within the first slot, wherein the sparking rod is configured to produce sparks when scratched with the scratcher.

14 Claims, 16 Drawing Sheets

FIRE STARTER KIT FOR FIREARM

TECHNICAL FIELD

The present disclosure relates to the field of firearms, and, more particularly, to a fire starter kit.

BACKGROUND

Fire starter kits are generally mounted on or near the magazine. This invention further improves the fire starter kit mounted on or near the magazine.

A compass, fire starting kit, flashlight, knife, whistle, pen, paracord bracelet, wire saw, emergency blanket and multi-tool are among the emergency survival items that can be employed, depending on the situation. Along with this, fire starters are used to ignite the fire in an emergency, such as in conditions with extreme cold, strong winds, and dampness.

Although starting a fire is an art, it may be done most effectively with the right equipment and knowledge of the different stages and growth of a fire. To heat combustion that is not relevant to the outside environment, a certain quantity of activation energy in the form of temperature is needed. Many things can catch fire, but it takes a lot of energy to ignite them. The initial energy can therefore be expended in an exothermic reaction of progressive phases using only a little quantity of activation energy by an end-user striking a material (for instance, like the ancient cowboy using flint to light a fire).

Convenience and portability are additional components of every fire starter kit. Although many survival kits may have good intentions, in reality, the end users frequently don't have them when they're needed. As a result, a clever design to keep them in the "empty space" of a device a responsible citizen would carry, such as a rifle, enables access to a fire starter kit that is connected to an item that is often carried in a particular weapon where the custom of always keeping a gun on the person, the holder of concealed carry, is prevalent.

Further, the fire starter kit known in the prior art is heavy in weight, which affects the weight distribution of the firearm in which they are fitted. The fuel used in the prior arts is fast-burning fuel like gunpowder or petrol, which fails to provide sufficient time to develop a self-sustainable fire.

There is, therefore, a need for a fire starter kit that is lightweight, can provide self-sustainable fire, is easy to use, fits in confined spaces of firearm handle and have a long shelf life.

SUMMARY

Some of the objects of the present disclosure, which at least one embodiment herein satisfies, are as follows:

In light of the above, an object of the present disclosure is to provide a fire starter kit.

An object of the present disclosure is to ameliorate one or more problems of the prior art or to at least provide a useful alternative.

Another object of the present disclosure is to provide a fire starter kit that is lightweight.

Yet another object of the present disclosure is to provide a fire starter kit that has a long shelf life.

Another object of the present disclosure is to provide a fire starter kit that can provide a self-sustainable fire that can last 3-5 minutes.

In an aspect, the present disclosure provides a fire starter kit that includes a frame, a scratcher, a sparking road, and at least one fuel reservoir.

The Frame is having a first end, a second end, a middle region, a recess provided on the middle region, and a first slot provided along the first end, the second end and partially through the middle region. The first end of the frame further comprises a grip portion that partially fits in the gun handle to hermetically seal the fire starter kit into the gun handle, the grip portion provides a grip for holding and manipulating the fire starter kit. The frame is made of a semi-flexible lightweight material selected from vulcanized rubber, natural rubber, low durometer rubber, or compressible plastics. In a preferred embodiment, the frame is made of low-durometer rubber. In another embodiment, the frame is made of a lightweight rigid material selected from thermosetting plastic, carbon fibre, or aluminium.

The scratcher is removably mounted in the recess, wherein the scratcher is having at least one first blade provided with a plurality of tooths. In an embodiment, the scratcher further includes at least one U-shaped slotted blade and at least one circular slot. In a preferred embodiment, two U-shaped slotted blades are present. The material of the Scratcher is selected from aluminium, cast iron, or steel.

The sparking rod is removably mounted within the first slot, wherein the sparking rod is configured to produce sparks when scratched with the scratcher. The material of the sparking rod is selected from iron, iron oxide, titanium, or white phosphorus.

The fuel reservoir is removably mounted over the sparking rod and the scratcher. The fuel reservoir has a fibrous material with a fuel hermetically sealed in a packing. The fuel is selected from a mixture of petroleum jelly and beeswax that produces flexibility in the resulting fuel and maintains structural integrity without breaking and fissuring. wherein the fuel is having petroleum jelly in an amount in the range of 10 wt. % to 50 wt. %, and the beeswax in an amount in the range of 60 wt. % to 90 wt. %. The fibrous material is selected from cotton, jute, timber or wood dust.

In another aspect, the present disclosure provides a method for starting a fire. The first step of the method is retrieving a fire starter kit from a handle of a firearm by pulling a frame of the fire starter kit. In the second step of the method is dismantling the fire starter kit to separate the individual components of the fire starter kit. The third step of the method is fixing a sparking rod in the first slot of the frame. The fourth step of the method is exposing the fibrous material of a fuel reservoir by twisting or cutting the fuel reservoir. The fifth step of the method is holding the frame fitted with the sparking road in front of the exposed fibrous material of the fuel reservoir. The sixth step of the method is creating a spark by scratching the sparking rod with a scratcher of sufficient temperature to ignite the fibrous material.

These aspects of the present disclosure, along with the various features of novelty that characterize the present disclosure, are pointed out in the below description. For a better understanding of the present disclosure, its operating advantages, and the specific objects attained by its uses, reference should be made to the accompanying drawing and descriptive matter in which there is illustrated an exemplary embodiment of the present disclosure.

BRIEF DESCRIPTION OF THE DRAWINGS

The advantages and features of the present disclosure will become better understood with reference to the following detailed description taken in conjunction with the accompanying drawings, in which.

Figure 1:
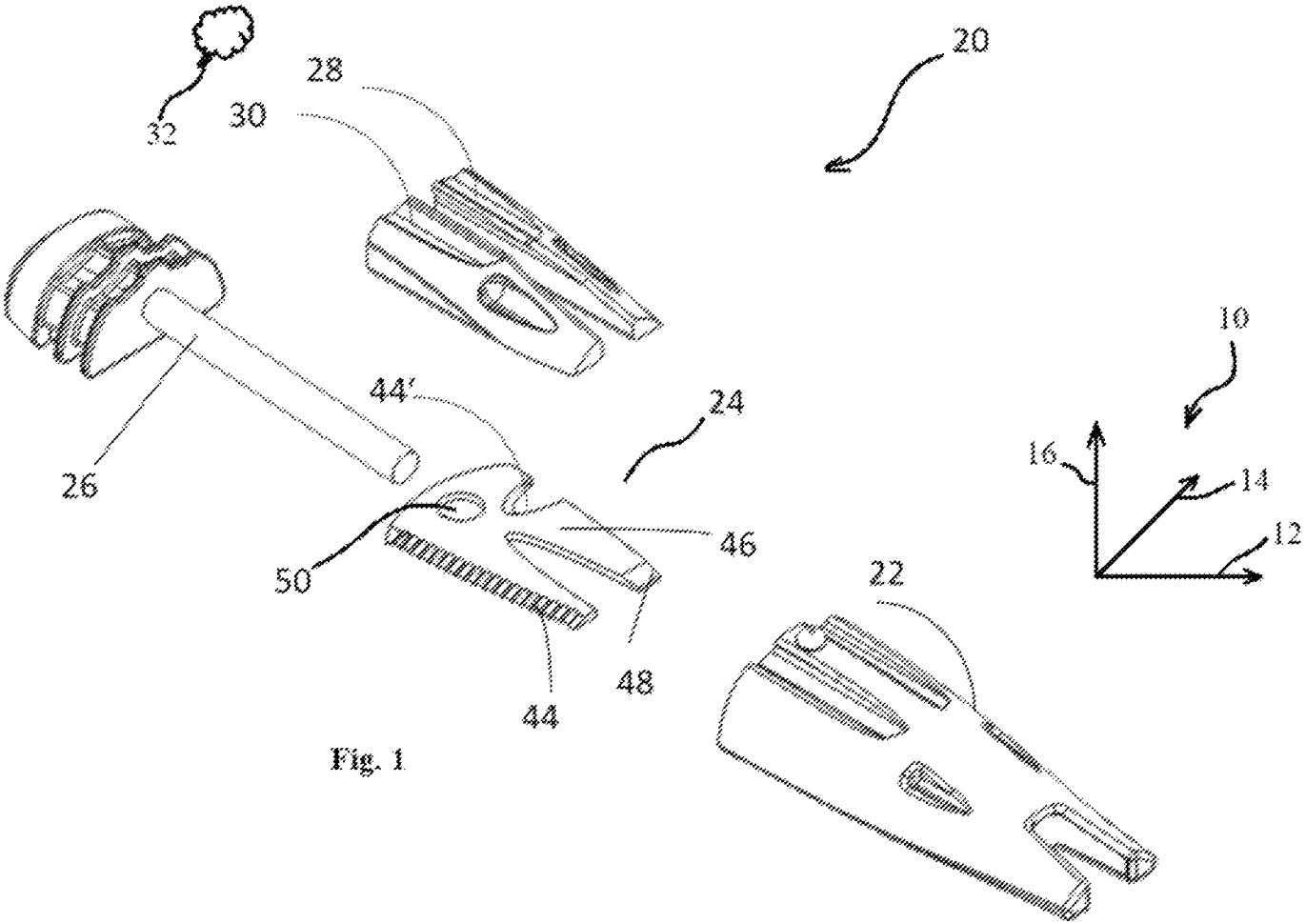
FIG. 1 illustrates an exploded view of a fire starter kit, in accordance with an exemplary embodiment of the present disclosure.

The headings used herein are for organizational purposes only and are not meant to be used to limit the scope of the description. To facilitate understanding, like reference numerals have been used, where possible, to designate like elements common to the figures. Optional portions of the figures may be illustrated using dashed or dotted lines unless the context of usage indicates otherwise.

DESCRIPTION OF THE DISCLOSURE

For a thorough understanding of the present invention, reference is to be made to the following detailed description, including the appended claims, in connection with the above-described drawings. Although the present invention is described in connection with exemplary embodiments, the present invention is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Similarly, the words "include", "including", and "includes" mean including but not limited to.

The terms, "a" and "an" herein do not denote a limitation of quantity, but rather denote the presence of at least one of the referenced items. As used throughout this application, the word "may" be used in a permissive sense (i.e., meaning having the potential to), rather than the mandatory sense (i.e., meaning must).

In one aspect, a fire starter kit configured to be stored in a firearm of an end user is provided. The firearm having a grip portion with a surface defining a longitudinally rearward cavity. The fire starter kit includes: a main body having an interior surface to form a storage compartment, the main body having an exterior surface; a scraper having a knife edge; a combustion rod having a base portion and a striker portion; a first fuel packet containing a fuel source therein, whereas the first fuel packet and the striker portion are contained within the storage compartment of the main body of the fire starter kit, and the main body from along the exterior surface is operably configured to be housed within the longitudinally rearward cavity of the grip portion of the firearm.

The scraper comprises a grip region substantially opposing the knife edge operatively configured to have the end user grasp the grip region to manipulate the scraper with the knife edge stroking the knife edge to operably configured to engage the striker portion of the combustion rod thereby creating a high temperature reaction sufficient to start a fire.

The storage compartment defined by the interior surface of the main body further houses a tinder material including compressible cotton modules, which is operatively configured to be mixed with the fuel source of the first fuel packet.

The fuel source may be a mixture of petroleum jelly and magnesium shavings.

The combustion rod comprises a cap, and the base portion of the combustion rod is operatively attached to the cap, the cap having a sealing edge configured to engage the interior surface of the main body whereby configured to hold the scraper and the first fuel packet and the striker portion of the combustion rod therein.

The fire starter kit further comprises a second fuel packet operatively configured to be positioned within the storage compartment of the main body laterally opposed to the first fuel packet with the striker portion of the combustion rod positioned there between.

The knife edge is configured to incise the first fuel packet or the second fuel packet to allow the fuel source to be applied to a tinder material operatively configured to combust by way of the scraper importing force on the striker portion of the combustion rod creating a spark and hence igniting the tinder material which in turn ignites the fuel source for a prolonged flame to aid in starting a heat producing fire.

The tinder material is comprised of a cotton material operatively configured to be stored within the storage compartment of the main body.

The tinder material is retrieved from the end user thereby intermixing the tinder material with the fuel source from the first fuel packet providing initial combustion when the end-user in parts force on the knife edge of the scraper to the striker portion of the combustion rod and the sparks the tinder material whereby igniting the fuel source for a prolonged combustion time longer than the duration of combustion supplied tinder source alone.

The first fuel packet may be filled with greater than 50% petroleum jelly and the second fuel packet may be filled with magnesium granules.

In another aspect, a method of starting a fire is provided. The comprising the steps of: retrieving a firearm having a grip portion and a longitudinally rearward cavity of the grip portion and removing a combustion rod having a striker portion from the longitudinally rearward cavity; removing a scraper from the longitudinally rearward cavity, the scraper having a knife edge; further removing a fuel packet containing a fuel source from the longitudinally rearward cavity; engaging the knife edge of the scraper with the striker portion of the combustion rod for creating a spark of sufficient temperature to ignite.

The fuel source may be petroleum jelly or may magnesium substrate, and the magnesium substrate may be in a powder form of smaller than 100 mesh.

In yet another aspect, a fire starter kit is provided. The fire starter kit includes: a main body having an interior surface defining a storage compartment, the interior surface having a lateral width; a scraper having a grip region and a knife edge, the scraper having a lateral width of sufficient size to fit in the lateral width of the interior surface of the main body; a first fuel packet having a fuel source contained in the first fuel packet and being sealed to prevent the fuel source from leaking therefrom; a combustion rod having a striker portion and a base portion, at the base portion a cap is provided to be configured to fit partially inside the storage compartment of the main body. The striker portion, scraper and the first fuel packet are all operatively configured within the storage compartment of the main body and attached to the base portion of the combustion rod holds the first fuel source, scraper and striker portion of the combustion rod there in the storage compartment of the main body.

The main body is operatively configured to fit within a grip region of a firearm. The firearm may be a pistol.

The fire starter kit further includes a second fuel packet, which may also be configured to fit within the storage compartment of the main body.

The fuel source in the first fuel packet is different from the fuel source in the second fuel packet, where the fuel source in the first fuel packet may be substantially comprised of petroleum jelly. The fuel source of the second fuel pack may be a ground flammable material.

Referring now to FIGS. 1 to 7B to describe a fire starter kit 20. As shown in FIG. 1, there is shown the fire starter kit 20. Before continuing to detail description of the fire starter kit 20, an axis system 10 for aiding in the description in orientation of a preferred embodiment is described. The fire starter kit 20 generally defined and orientated by way of referencing the axis system 10, as shown in the forward portion of FIG. 1. The access system 10 comprises a vertical axis 12, a lateral access 14 and a longitudinal axis 16 where the arrow of actually 16 is pointed in a longitudinal rearward position with respect to the exploded view of components of FIG. 1. It should be noted in axis system 10 primarily orientated around the preferred storage location for operational caring within the handle of a firearm.

As shown in FIG. 1, the fire starter kit 20 comprises a main body 22, a scraper 24 and a combustion rod 26. Further, the fire starter kit 20 comprises in one form, a first fuel packet 28, and in another form, the fire starter kit 20 additionally comprises a second fuel packet 30. Further, in most preferred form, the fire starter kit 20 comprises a compressed cotton module 32 or otherwise referred to as a tinder material.

Figure 2:
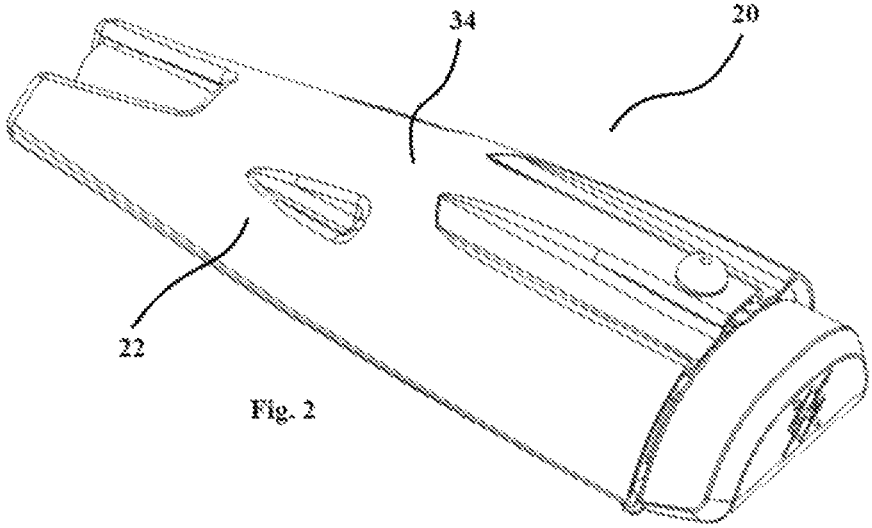
FIGS. 2 and 2A illustrate assembled views of the fire starter kit of FIG. 1 where all of the various components are contained therein a main body of the fire starter kit, in accordance with an exemplary embodiment of the present disclosure.
Figure 2A:
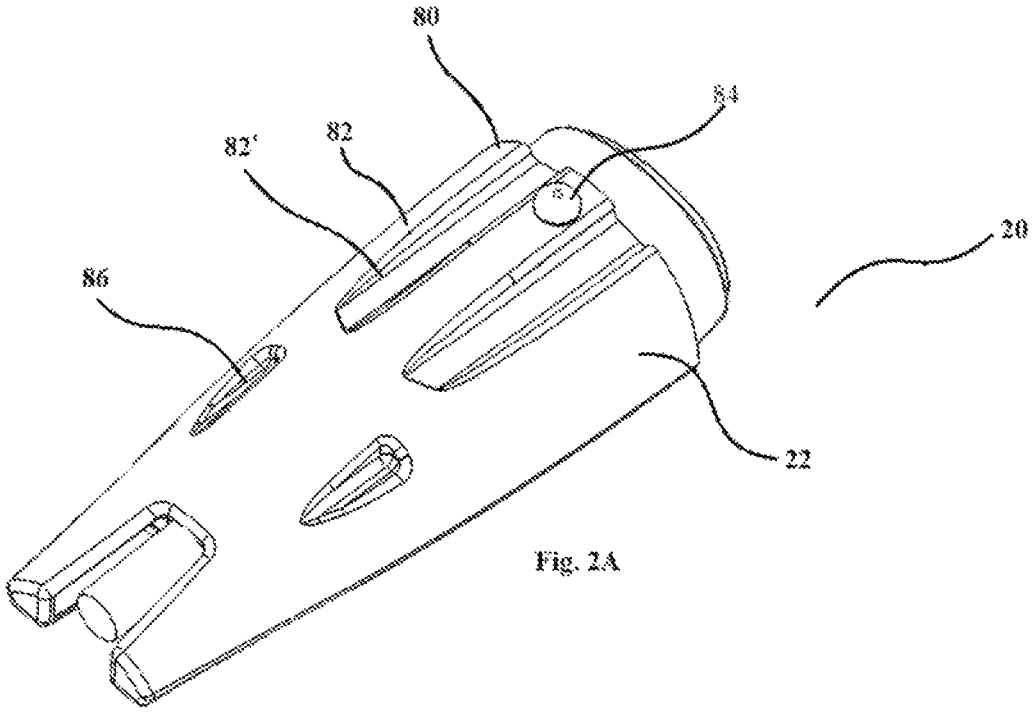

The fire starter kit 20 is shown in the most preferred form having the components described above where the combustion rod 26 in combination with some form of a bladed device, like the scraper 24, may create a spark. Fire starting is an art but an art which can be best carried out with the proper tools and knowledge of the various phases and progression of a fire. A certain amount of activation energy is required in the form of temperature to heat immaterial to inside combustion. Many items are combustible, but require a great deal of activation energy. Therefore, utilizing a minimal amount of activation energy by an end-user striking a material (example as in the old cowboy using flint to start a fire) the initial energy can be expounded in an exothermic reaction of progressive phases until a proper survival fire can be started. Of course, conventional materials other than what is contained in the kit can be utilized but a preferred form the fire starter kit would have the core elements all self-contained, such as shown in FIGS. 2 and 2A.

Figure 5A:
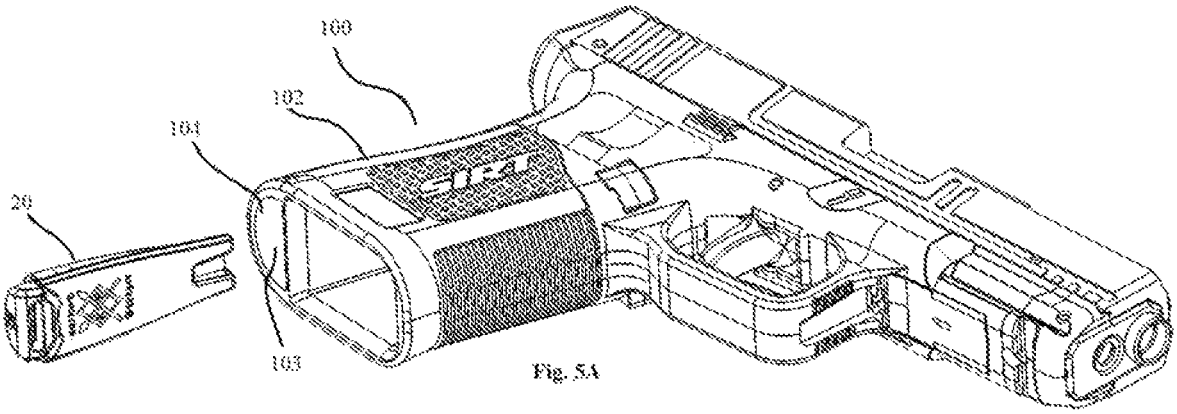
FIGS. 5A and 5B illustrate the fire starter kit configured to be inserted in a cavity of a firearm, in accordance with an exemplary embodiment of the present disclosure.
Figure 5B:
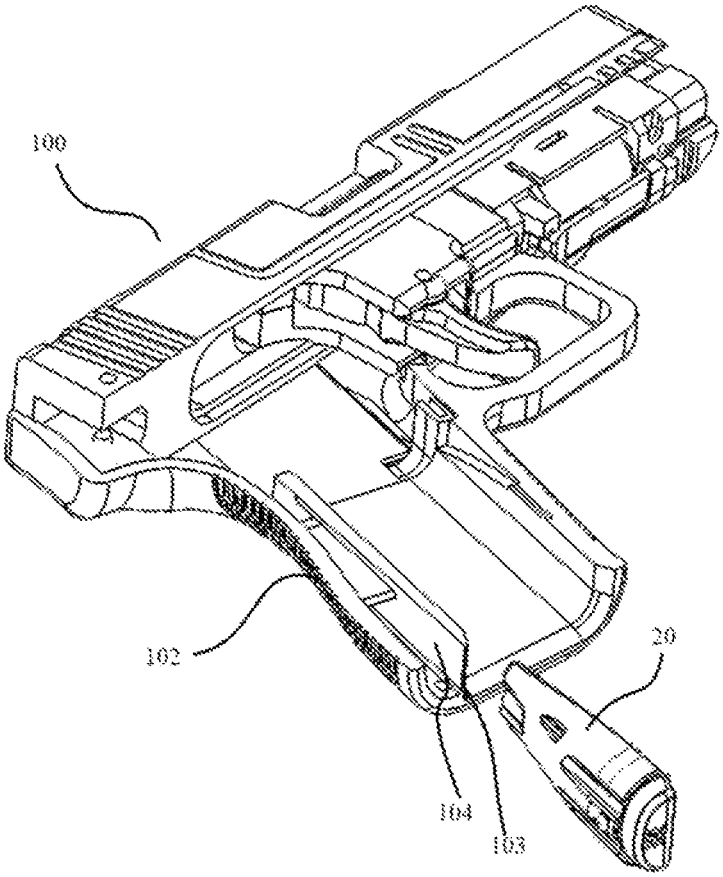

Another element of any fire starter kit is convenience and ease of carrying. Many survival kits are perhaps well intended, but in practice the end-users simply don't have them when they need them, Therefore a clever design to store them in "empty space" of a device a capable citizen would carry, such as a firearm, allows for a fire starter kit to be accessible with that being associated with an object that is commonly carried particular firearm where the culture of carrying a firearm, such as that as shown in FIGS. 5A and 5B, generally having it with the end user, the concealed carry holder, at all times. In particular in the woods and other remote areas where individual may need to start a fire for warmth and perhaps survival to evade hypothermia.

Figure 3:
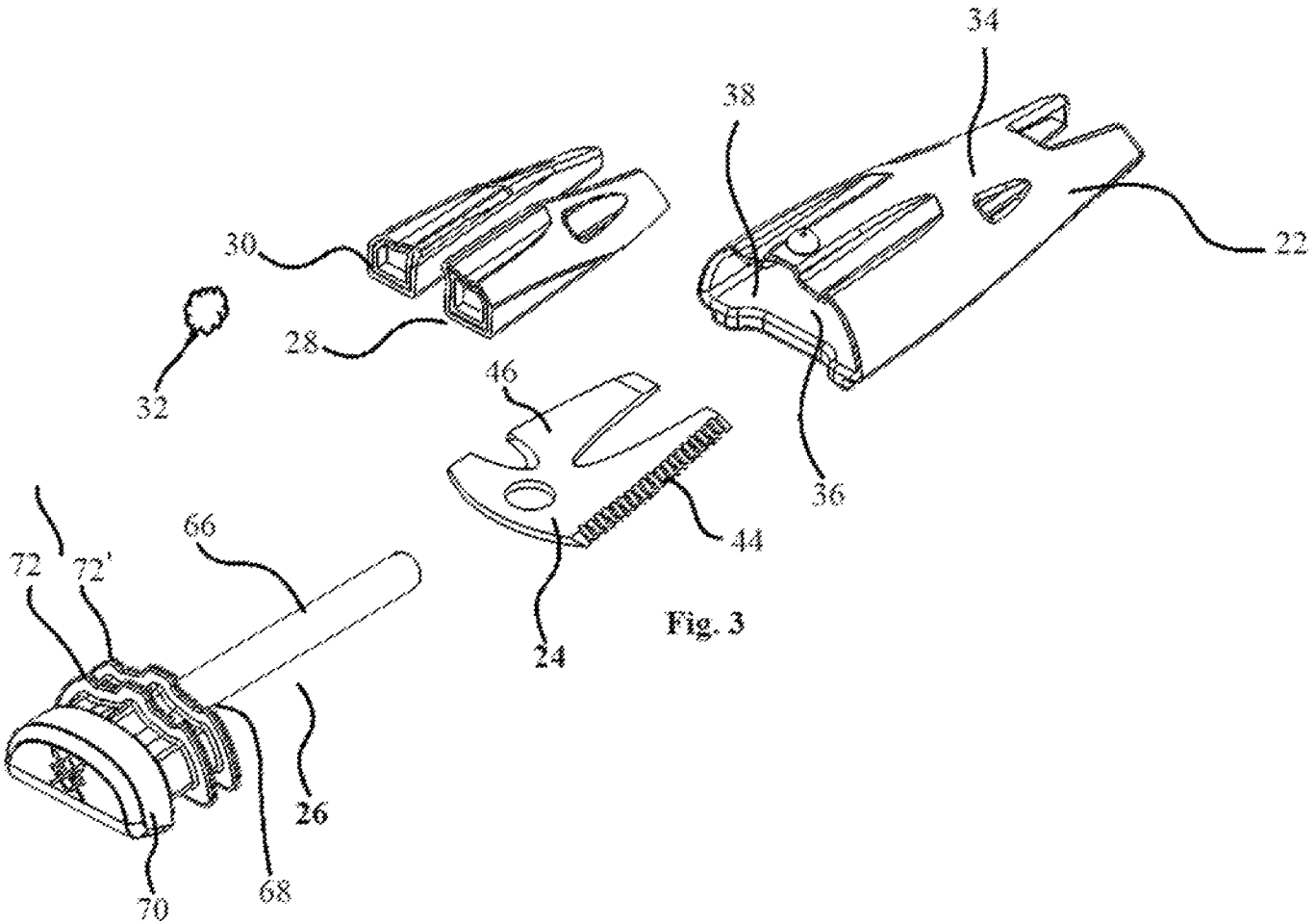
FIGS. 3 and 4 illustrate exploded views of the fire starter kit depicting various components of each and every element of the fire starter kit, in accordance with an exemplary embodiment of the present disclosure.

Therefore, with the foregoing in place as a foundational understanding more detail description of the components in a preferred form will now be described. FIGS. 2 and 2A show the fire starter kit 20 in an assembled orientation where all of the various components are contained therein the main body 22. The main body 22 comprises an external surface 34, and as shown in FIG. 3 and an internal surface 36. As shown in FIG. 3, the internal surface 36 defines a storage compartment 38. The storage compartment 38 is of sufficient capacity to store the scraper 24, at least one of the two first or second fuel packets 28, 30, a striker portion 66 of the combustion rod 26, and as an option, compressed cotton modules 32.

Figure 4:
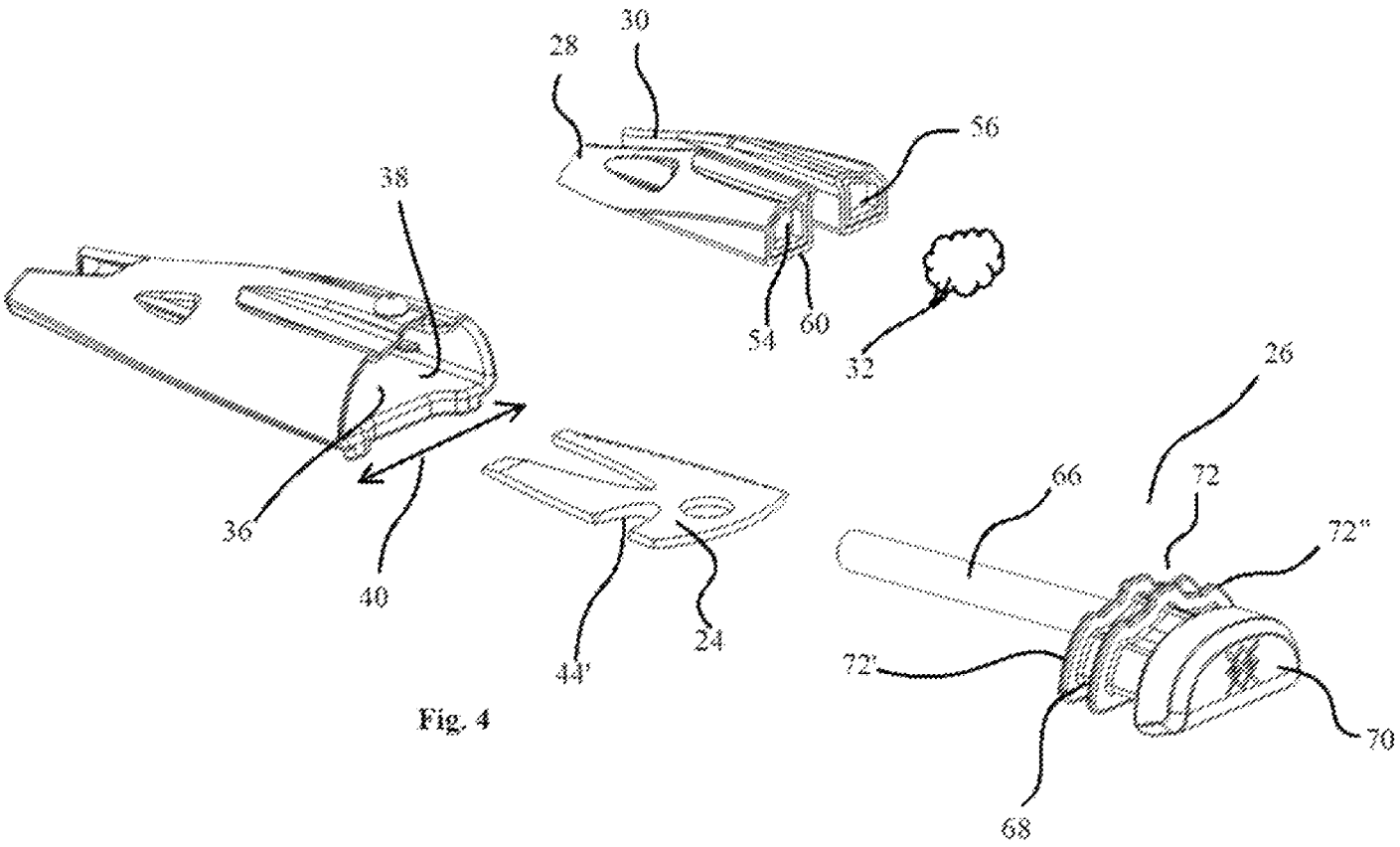

As shown in FIG. 4, the interior surface 36 comprising the storage compartment 38, and has a lateral width, indicated by arrow 40, which is a sufficient width to allow the scraper 24 to be housed therein. In other words, the scraper 24 having a lateral width of a sufficient size to fit in the lateral width (as indicated by arrow 40) of the interior surface of the main body. In one form, the scraper 24 is positioned in a longitudinal forward region of the storage compartment 38.

As shown in FIG. 1, the scraper 24 has in one form a knife edge 44. Opposed the knife edge 44 is a grip region 46. It has been found in experimentation that a preferred form of a knife edge is a serrated blade, common in the art of knife making, having small extension like areas as opposed to a uniform knife edge like a conventional knife. The separations tend to have higher pressure points upon the combustion rod 26. However, in one form, in addition to the knife edge 44, there is provided separations 44', which is also shown in FIG. 4. The separation 44' is a curved type design to gently wrap around the striker portion 66 of the combustion rod 26. Depending on the scale and dexterity and idiosyncrasies of the end-user, either one of these of knife edges 44 or separations 44' is suitable, but in practice, a serrated blade has tended to work actually better than a conventional knife edge. The scraper 24 may further be provided with other potential functionality, such as a flat screwdriver area 48 and a surface defining a hole 50 so the unit could be attached to a lanyard, para cord or other piece of string cording or fastener. When used in a survival situation instead of storing, the store in the striker back inside the main body 22 it may be deployed and for example tied as a necklace to be put around the end-user's neck just as an example. It should further be noted that the knife edge 44 or the knife edge prime can be used to open the fuel packets, such as the first and second fuel packages 28 and 30, respectively.

As best shown in FIG. 4, the first and second fuel packages 28 and 30 or of one form is somewhat symmetrical design operatively configured to have an outer surface to fit snugly there within the main body 22. In a preferred form, the striker portion 66 of the combustion rod 26 fits between the first fuel packet 28 and the second fuel pack and 30. A number of suitable fuels may be placed in the first fuel packet 28 and the second fuel pack and 30 of the main body 22. Generally speaking, the fuel within both or either of the first and second fuel packets 28, 30 are of a combustible nature. It could be the same fuel source for starting multiple fires or a combination of fuel sources. In one form, the fuel source can be highly combustible material, such as magnesium granules or have a conventional gunpowder of sufficient burning rate to allow for the heat there from to burn other material such as dry twigs and leaves to start a fire. In another form, the fuel mixtures within the first fuel packet 28 and the second fuel pack and 30 may be one for combusting the spark in case the cotton in the compressible cotton module 32 is wet, partially externally moist already used so other material, such as a piece of a shirt, or not within the fire starter kit 20. In another form, the second fuel back 30 may contain a mixture, such as petroleum jelly or other hydrocarbon-based liquid/gelatin material to provide a sustained burn for a longer duration of time then the conventional ground magnesium or gunpowder or cotton by itself. This longer sustain burn allows for a transfer of heat to other materials to grow the fire and make it self-sustaining and more robust to handle what are materials applied there too, wind or other rigors that may potentially put out a life-saving fire.

Through experimentation, the best practice initially is having a compressible cotton module 32 which may be placed inside or interposed between the ceiling edge 72 of the base portion 68 of the combustion rod 26 and, as shown in FIG. 4, the base ends 54 and 56, respectively, on the first and second fuel packets 28 and 30. There may be a wide variety of materials that are combustible to be placed inside the first fuel packet 28 and the second fuel pack and 30, hereinafter may be also be collectively referred to as fuel packets. In the preferred form, the fuel packet may be hermetically sealed not to allow any material to escape therefrom and importantly not to let moisture of water seep therein compromising the effectiveness of the combustibility. Further, hermetically sealed packets may prevent solid material that could potentially be oxidized material contained therein to remove the potential of corrosion or otherwise removing the ability to combust from the fuel source.

The fire starter kit 20 may comprise only one of the two fuel packets. So, for example, the first fuel pack of 28 is positioned there in the storage compartment 38 of the main body 22. And in the other open portion, a tinder material, such as a compressed cotton module 32, squashed and contained therein. In another form, the compressed cotton module 32 could be longer and extend within that elongated cavity area, such as, within the main body 22.

In one form, the first fuel pack of 28 and the second fuel packet 30 are both employed and both have the same fuel source contained therein. The fuel source may be petroleum jelly or at least majority may be petroleum jelly and perhaps other additives and other forms, such as with magnesium granules or other types of fire-starting additives. Magnesium granules may be defined as magnesium metal or substantially magnesium metal that is either a powder form or a shaving form. Magnesium granules may come in a powder like form, for example between 20 mesh to 200 mesh and may readily available in the market. Magnesium granules can further be derived from a scraping action on a magnesium block or magnesium alloy that may be non-spherical but rather is derived from a byproduct of machining processes.

Petroleum jelly may be desirable fuel source because when applied to a substrate, such as stranded frayed cotton, the cotton tends to initially burn and requires a little activation energy to start from the spark and portions of the petroleum jelly are thereby heated and melt and presumably turn into a gas and combust. Therefore, the cotton acts as a wicking agent coupled with the petroleum jelly to have a long-sustained burn. It has been found through experimentation that street petroleum jelly may not ignite by way of a spark from the combustion rod 66 on its own and not stay lit on its own unless it is applied to a substrate having that wicking type action. Therefore, the combination of petroleum jelly as a fuel source with a combustible burning substrate such as cotton even a conventional cotton ball is a great source to start a fire and have a sustained burn thereafter to further ignite other material for a life-saving fire.

In yet another embodiment, the compressed cotton module 32 may not be supplied in the fire starter kit 20 but rather the end-user supplies a cotton like or polyester substrate which is mixed with petroleum jelly extracted from the first or second fuel packets 28 or 30 in this form, the end-user could for example use the scraper 24 and in particular the knife edge 44 which is of a serrated design to tear up and cause a lot of frayed edges within for example a piece of a cotton shirt or cotton underwear. Mixed with the Vaseline, the cotton will initially ignite and burn the Vaseline. It appears that the Vaseline goes from the gelatin stage to liquid to a gas heater stage where it burns much like a conventional candle allowing the heat to combust other conventional materials in the survival area such as dried bark, dried portions of a stump, leaves, small twigs basically combustible materials presumably from wood products with as much surface area to mass ratio to build a sustainable fire.

In yet another embodiment, the first fuel packet 28 may for example contain a petroleum jelly or a substantial prime jelly mixture, which may be greater than 50% petroleum jelly if not 100% petroleum jelly. The remaining 50% can be other additives. But for a preferred embodiment, you're the source in the first fuel packet 28 may be petroleum jelly, and a fuel source in the second fuel packet 30 may either be additional petroleum jelly or a magnesium substrate. Magnesium substrate may be powdered magnesium, magnesium shavings or even in one form a solid piece of magnesium which are shaved down from the knife edge 44 of the scraper 24. A solid piece would be the least desirable in the situation given the difficulty of shaving in an emergency situation. But for example, powdered magnesium with a high surface area to mass ratio can be easily ignited and allow the petroleum jelly to be ignited as it rests on a wicking material. In one form, the wicking material may be the compressed cotton module 32 that is stretched out and forms a dendrite extended like webbing of cotton strands which are ignitable by way of a spark from the striker portion 66 when scraped from the scraper 24. However, in adverse circumstances or when the fire starter kit 20 may not have a cotton module, the end-user may use any kind of working substrate, such as cutting off a piece of their clothing, gear or readily available flammable material, preferably one with wicking ability. Generally speaking, cotton tends to start to burn with low activation energy better than polyethylene. Therefore, a second fuel source in the second fuel packet 30 that is ignitable and also produces enough heat to start the petroleum jelly burning is very desirable. 20-200 mesh magnesium powder has been tested and is conventionally available and can be reasonably safely packed and manufactured to fit within the interior chamber portion of the second fuel packet 30.

Furthermore, there may be many combinations but the most desirable combination is to give the end-user a sufficient supply material to start at least one fire with extra material to start a second fire. Having the first and second fuel packets 28 and 30 coupled with cotton and of course the scraper 24 with the knife edge 44 is a most preferred form to give the end-user the highest probability of starting a fire in the most adverse circumstances of cold environment, high wind and moisture. Moreover, the most important element of a survival kit, such as the fire starter kit 20, may be actually having it readily available with the person. Therefore, having the entire kit, such as the fire starter kit 20, as shown in FIGS. 5A and 5B, to conveniently packed within a pistol 100 puts the end-user in an extraordinarily better position to survive a very dire and potentially life-threatening, hypothermic scenario.

Before moving on from the discussion of the first and second fuel packets 28 and 30, it should be noted a preferred form of manufacturing and making such the first and second fuel packets 28 and 30 is to use plastic injection process to obtain very thin wall to save space and as best as shown in FIG. 4, at the longitudinally forward edge of the base region 54 is a generally linear area shown as straight edge 60 on the first fuel packet 28. This longitudinal strip of area may be a living hinge so that the plastic injection of the beach bass region 54 is rotated about the straight edge 60 for an open and shut tool, and in a manufacturing process, the interior chamber may be filled with combustible material and folded over and then heated, or use of an adhesive, such as hot glue, to make it hermetically sealed chamber. In one form, the first and second fuel packets 28 and 30 may be marked in plastic injection or marked in the healing process to note which packet contains which fuel source if two fuel sources are used. Further, the color of the first and second fuel packets 28 and 30 may be a color representing the contents, for example, a magnesium source may be colored grey, a petroleum jelly source may be colored black or white, depending on available plastic colorants.

There will now be a final discussion of the detailed components of the combustion rod 26. As shown in FIG. 4, the combustion rod 26 comprises a striker portion 66 and a base portion 68. The base portion 68 is comprised of a cap 70. The cap 70 may be a plastic injection cap. The base of the striker portion 66 is press fit into the cap 70. In a preferred form, the cap 70 may be provided with the sealing edge 72, which in a preferred form may be first and second ceiling edges 72' and 72". The sealing edge(s) is operatively configured to fit there in the main body compressively engage in the interior surface 36 of the main body 22. The striker portion 66 in a preferred form may comprised of a common spark igniter material, such as Ferrocerium Rod invented in 1903 by the Austrian chemist Carl Auer von Welsbach. Said material is widely used as a fire starter but often times sold and marketed by itself where they can provide a certain amount of spark of high temperature but of low thermal mass. Great for igniting tinder but as noted above, a proper robust fire-starting kit must contain additional elements to start the fire in the worst-case scenarios.

Figure 7A:
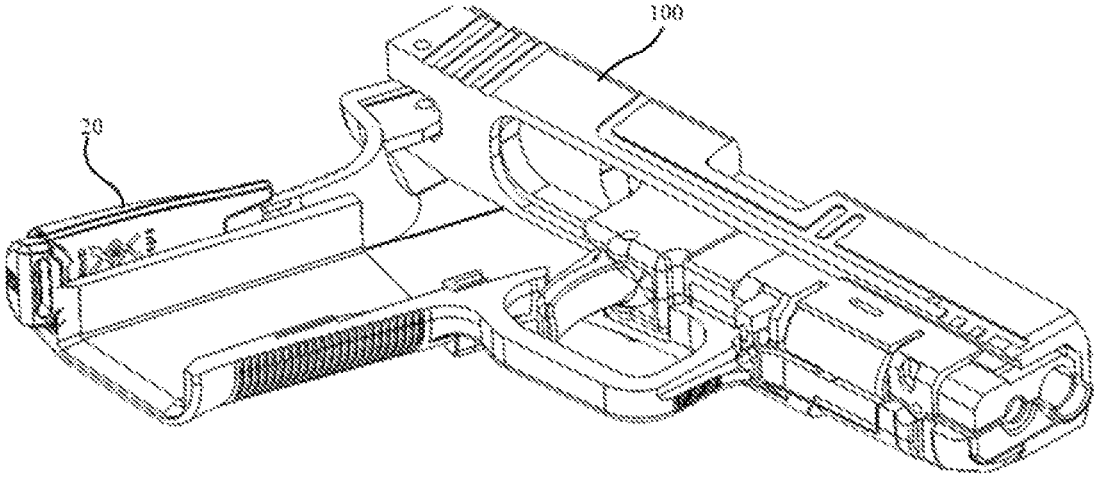
FIGS. 7A and 7B illustrate the fire starter kit inserted in the cavity of the firearm, in accordance with an exemplary embodiment of the present disclosure.
Figure 7B:
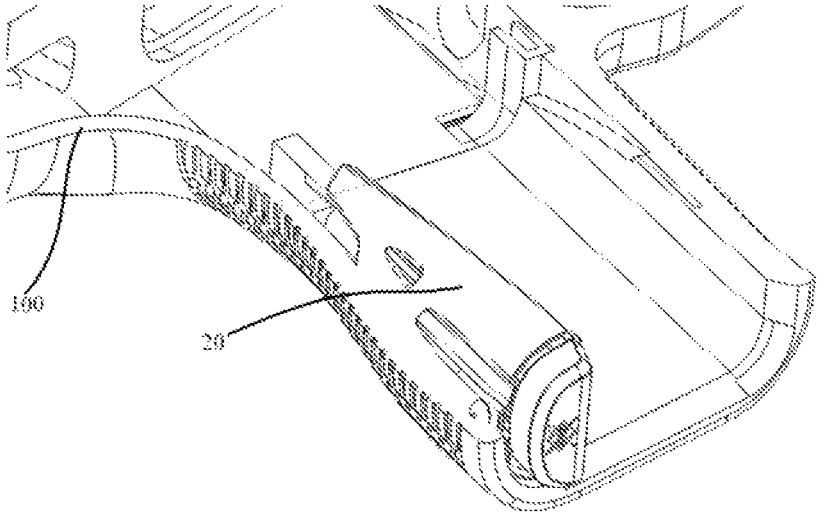
Figure 8:
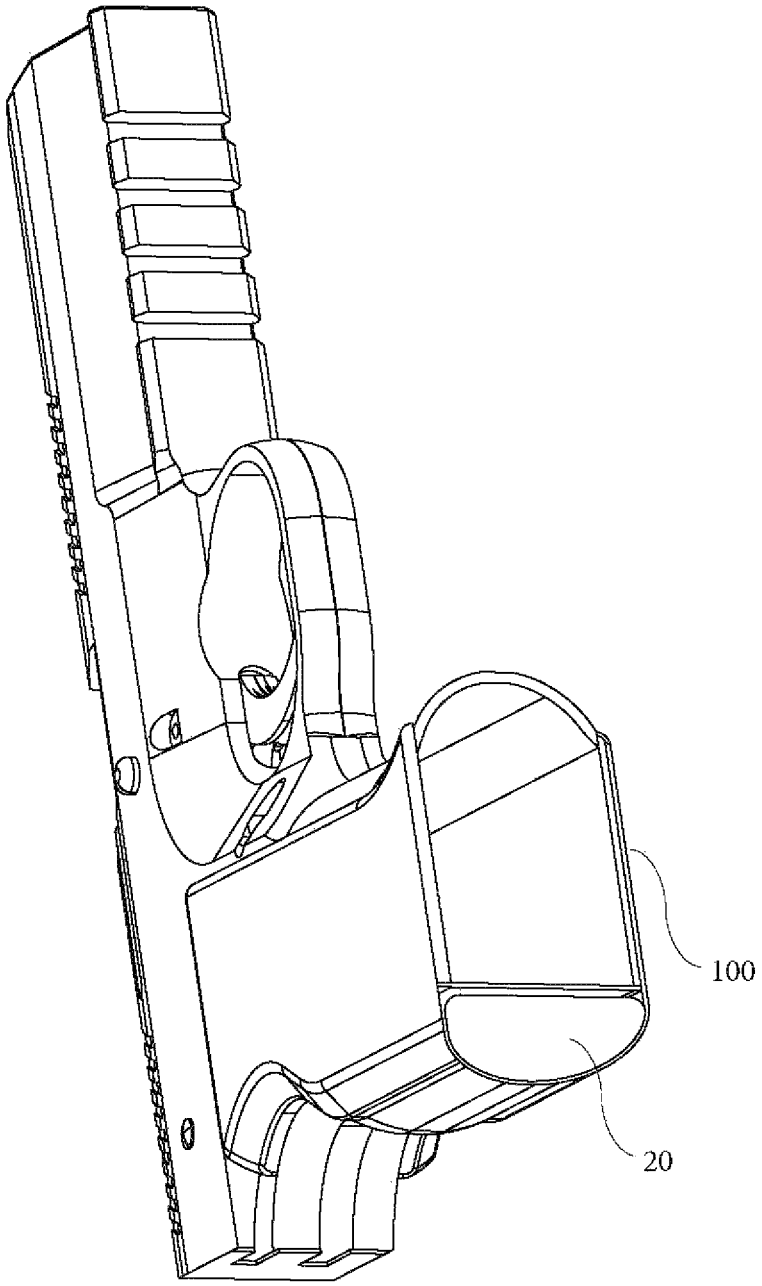
FIG. 8 illustrates the fire starter kit inserted in the cavity of the firearm, in accordance with an exemplary embodiment of the present disclosure.
Figure 9:
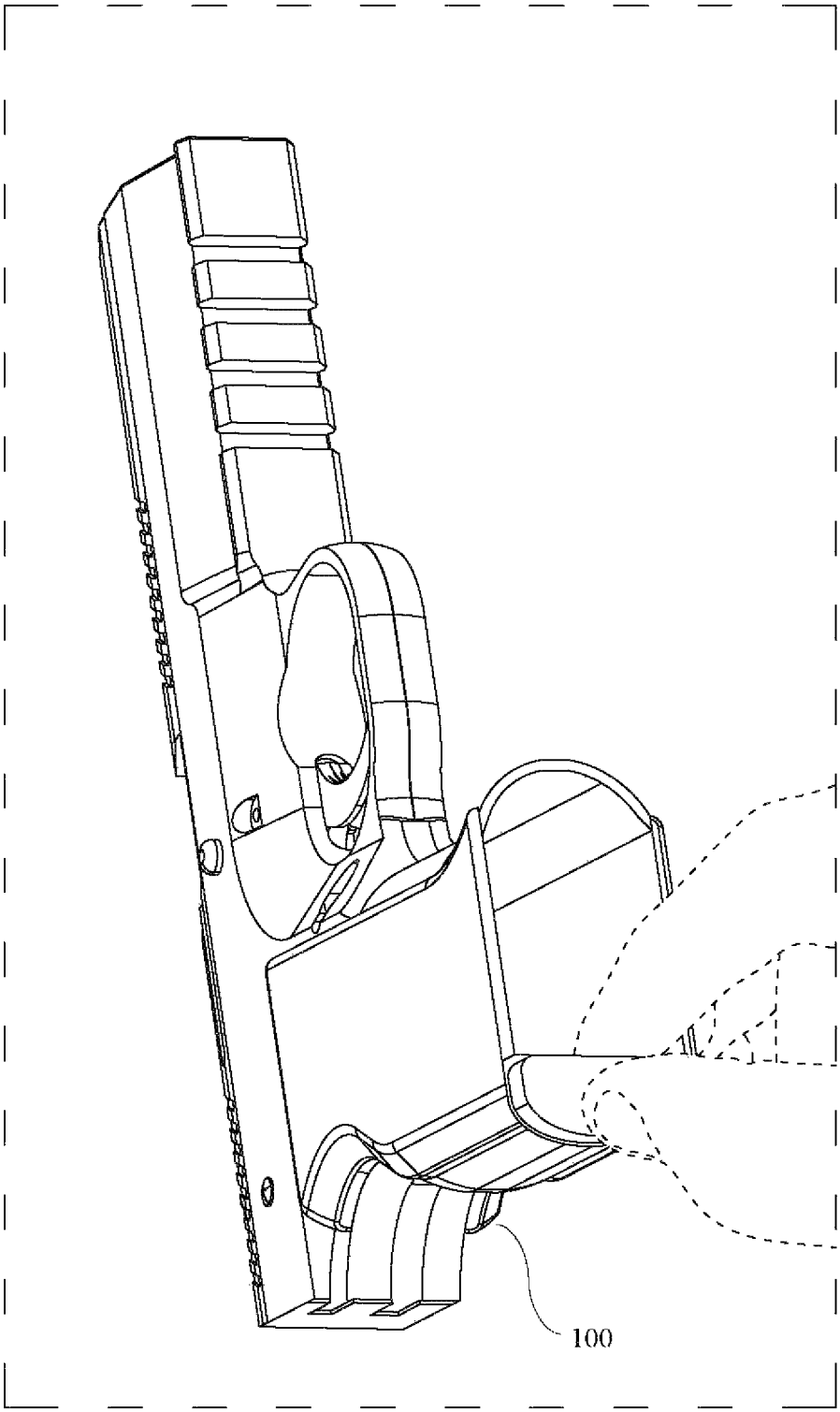
FIG. 9 illustrates the fire starter kit pulled out from the cavity of the firearm by a user, in accordance with an exemplary embodiment of the present disclosure.
Figure 10:
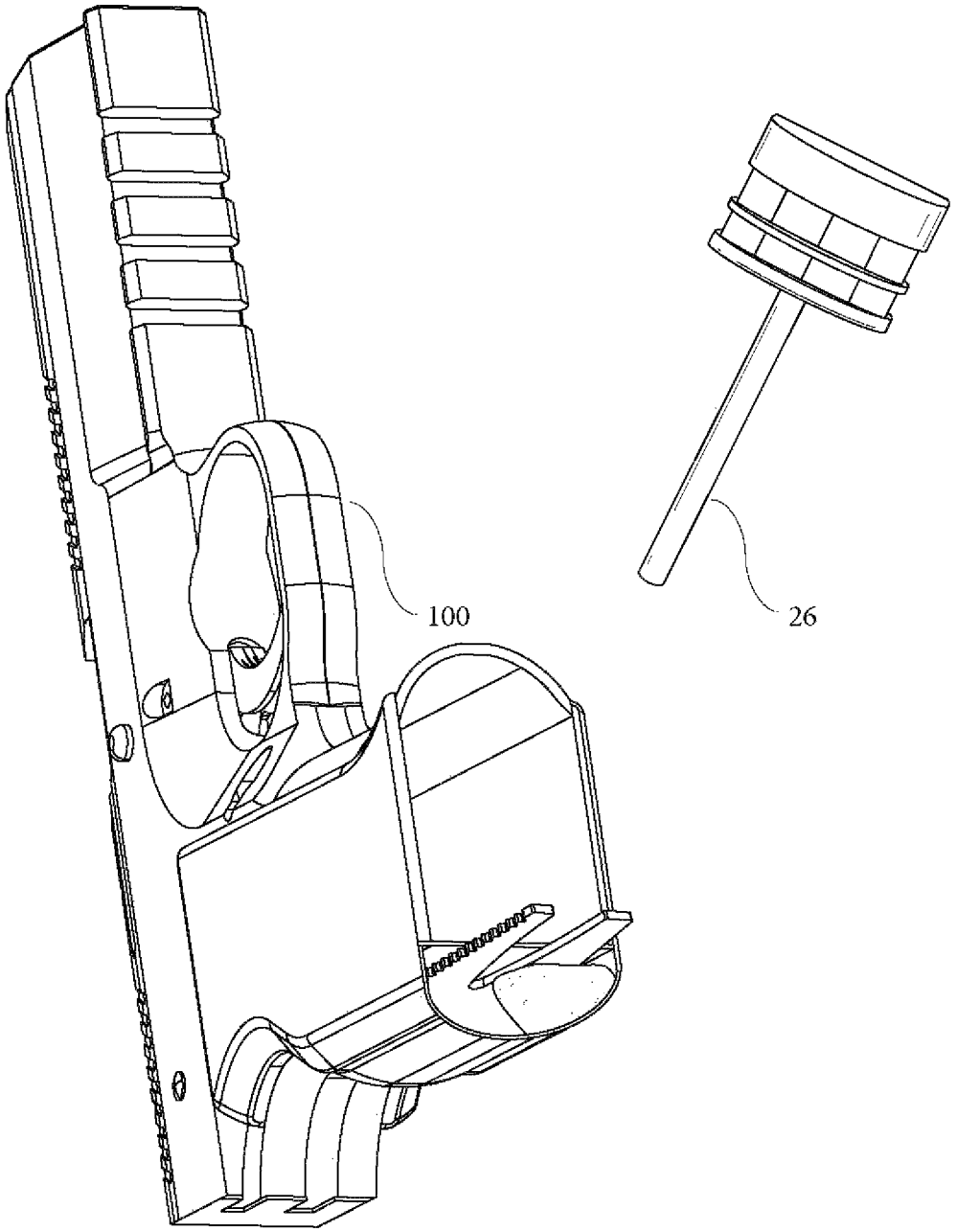
FIG. 10 illustrates the combustion rod of the fire starter kit pulled out from the cavity of the firearm, in accordance with an exemplary embodiment of the present disclosure.
Figure 11:
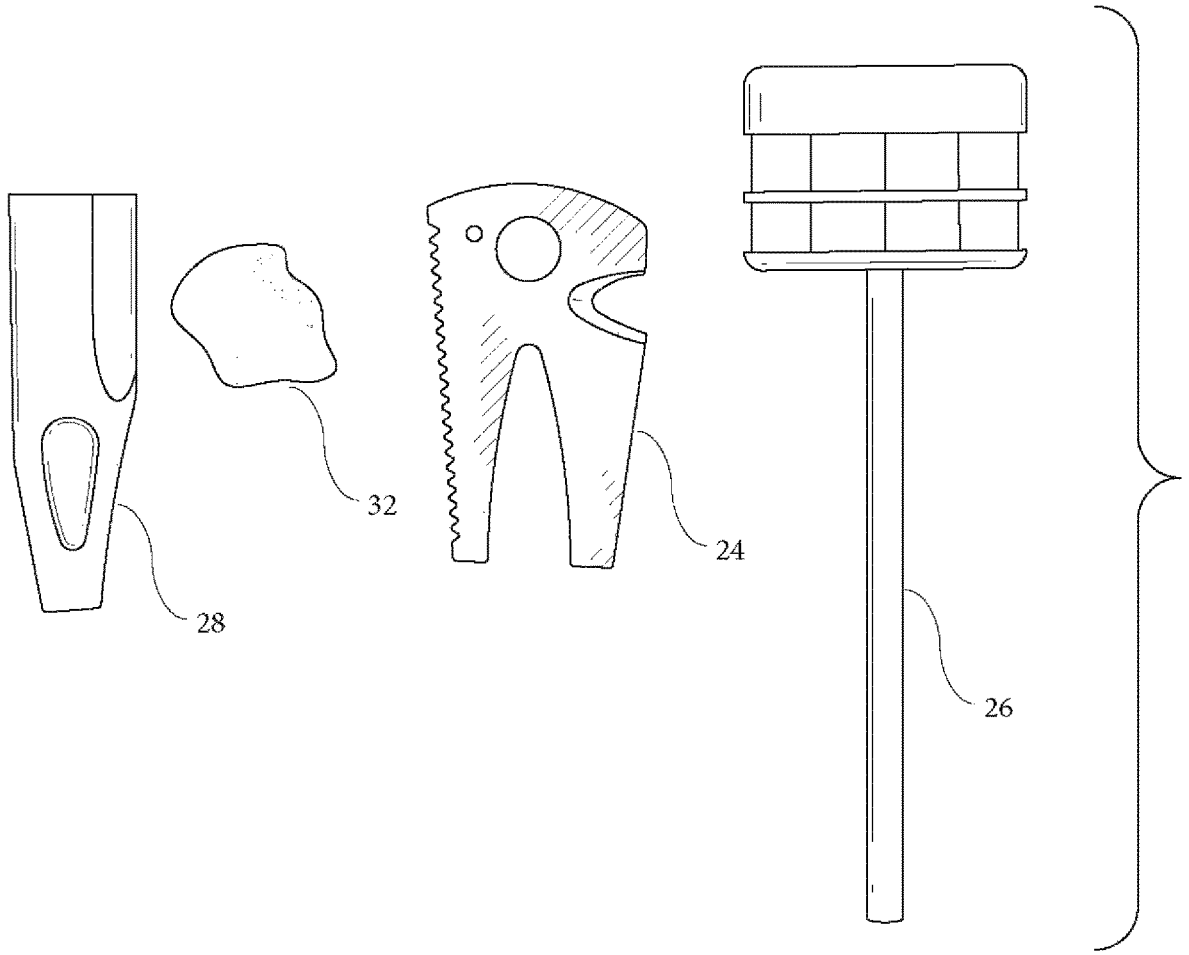
FIG. 11 illustrates all the components of the fire starter kit pulled out from the cavity of the firearm, in accordance with an exemplary embodiment of the present disclosure.
Figure 12:
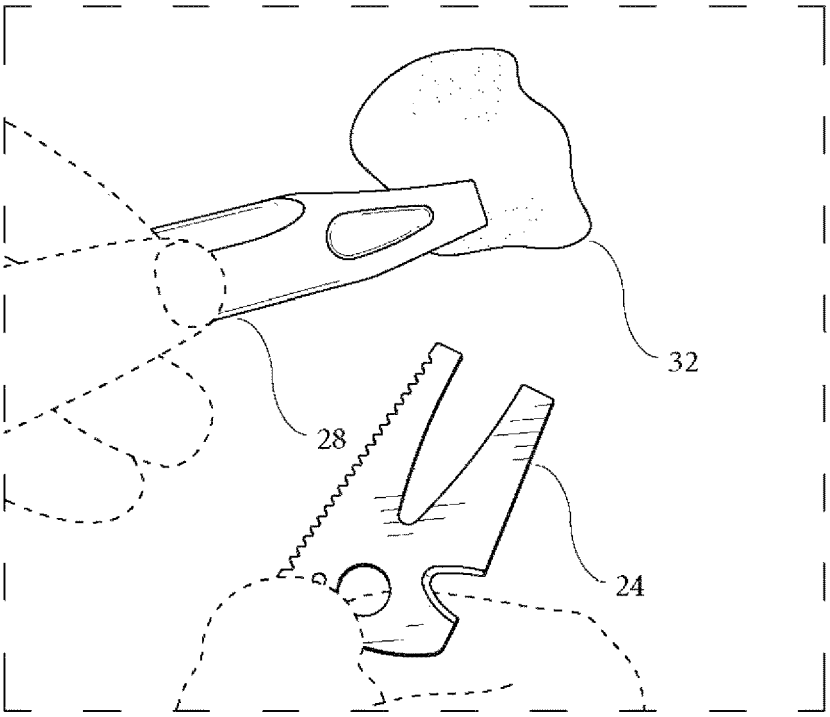
FIG. 12 illustrates the use of a scraper to cut the fuel packet, in accordance with an exemplary embodiment of the present disclosure.
Figure 13:
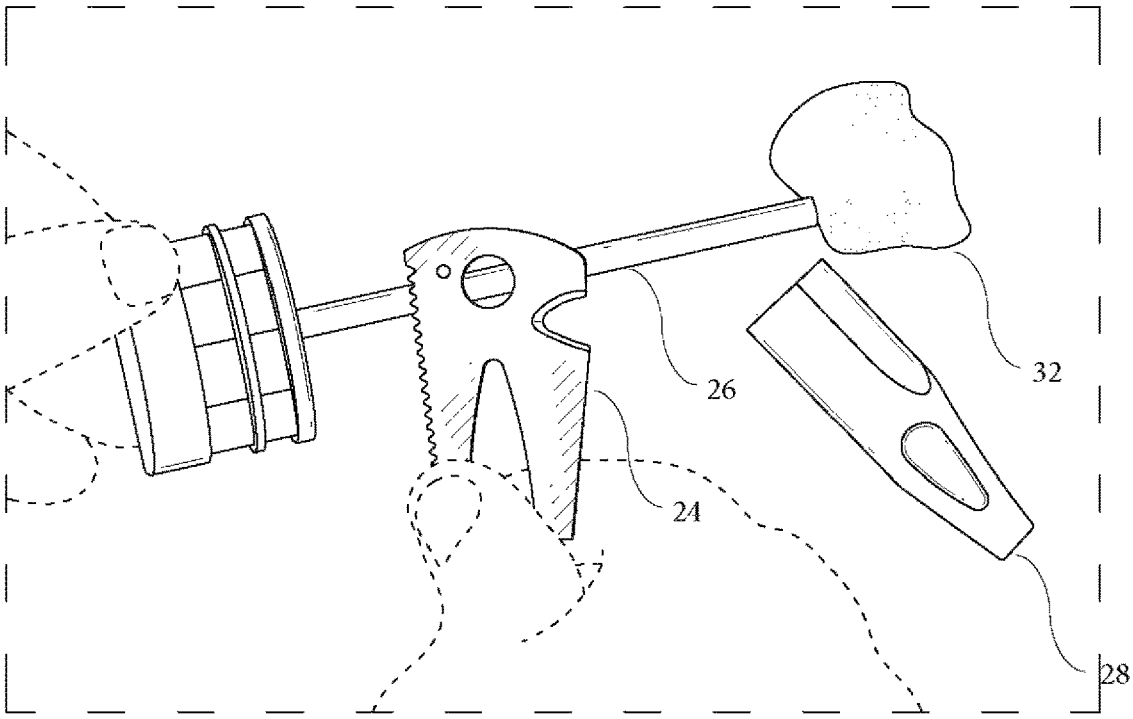
FIG. 13 illustrates the use of a scraper and combustion rod to start the fire, in accordance with an exemplary embodiment of the present disclosure.
Figure 14:
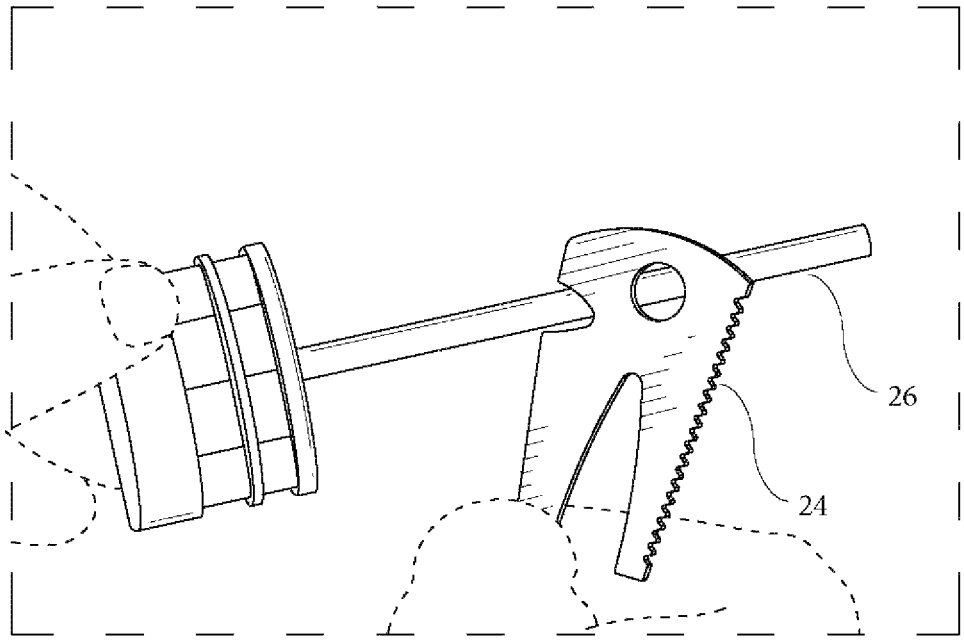
FIG. 14 illustrates the use of a scraper and combustion rod to start the fire, in accordance with another exemplary embodiment of the present disclosure.

With a foregoing description of the various internal idiosyncrasies and components of the fire starter kit 20, there will now be a detailed discussion of the storage capabilities of the fire starter kit 20 particularly referencing the exterior surfaces of the main body 22, as shown in FIGS. 2 and 2A. Fitting the fire starter kit 20 within the unused space of the firearm, as seen in FIGS. 7A and 7B, is a bit of a tricky endeavor. Various types of firearms may be available, and accordingly may have different generations, each having different cavity sizes. Further, compound of such firearms matters most and users don't know which generation of the firearm they have. Although, the fire starter kit 20 may be stored in a plurality of firearms, the specific embodiment as shown by the drawings is configured to fit in a Glock™ or particularly a Glock™ 17 or 19 which is a full-size or compact (The applicant, inventors and assignees have no affiliation or source of goods or otherwise any connection businesswise or otherwise to Glock™ Inc. of Smyrna Georgia and the images in this application are not that exactly of a Glock™ but are of a design to show the concepts of the claimed invention). The dimensions are slightly skewed to fit in either one of these pistols but the more challenging aspect of fitting into these models is a generation. A generation three Glock™ has a distinctly different rear cavity than a generation four or a generation five. Generation four or five Glocks™ further have exterior rear grip attachments that will actually sit there around the floor base edge of the main body 22 and keep it contained there in those allowing the combustion rod 26 and may need the cap 70 to be extracted there out around the space of a grip attachment 102 of the firearm 100. Therefore, as shown FIGS. 5A and 5B, the fire starter kit 20 in and assembled state trying to be inserted into the pistol 100, and more specifically in the grip 102.

As shown in FIGS. 5A and 5B, the grip attachment 102 includes a surface 103 defined to include a longitudinally rearward cavity 104, also referred to as rearward cavity. Generally speaking, the rearward cavity 104 may be open and just has nothing therein other than surrounding atmosphere. However, the contours of the rearward cavity 104 may be specific to a generation 3 versus a generation 4 or 5 Glock™ model. Referring back to FIG. 2 and FIG. 2A, more specifically to FIG. 2A, there is seen that the fire starter kit 20 includes a longitudinally rearward surface 80, which include a region 82 that has an indentation 82' to fit within a generation 4 or 5 5Glock™ (In one form, a 17 or 19 which is probably the largest market of Glocks™ in production). Further, an extension 84 is provided to fit within a surface to find a hole in the grip area of the Glock™ to have the main body 22 of the fire starter kit 20 locked therein. However, a generation three Glock™ which does not provide a corresponding surface to frictionally engage the indentation 82' on the surface is 82 or the extension 84, requires services 86 which are in dented but yet frictionally engage a set of fins that are commonly within a generation three Glock™. Even though the end use in one form is intended for a Glock™, it should be noted that the pistol as shown in the drawings is for demonstrative purposes and not a Glock™ but rather in more generically formed pistol. Of course, in a broader scope fire starter kit 20 may be stored in other models of pistols and other types of firearms, such as foldable subcompact, rifles etc.

Figure 6A:
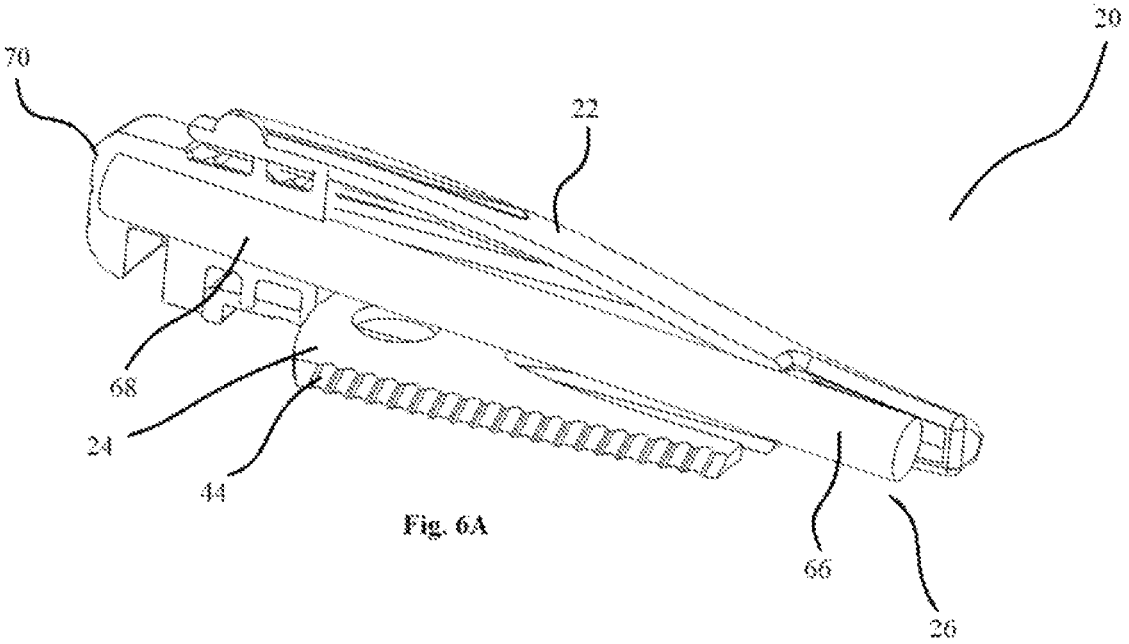
FIGS. 6A and 6B illustrate cross sectional views or semi-exposed views of the fire starter kit to depict internal arrangements of various elements, in accordance with an exemplary embodiment of the present disclosure.
Figure 6B:
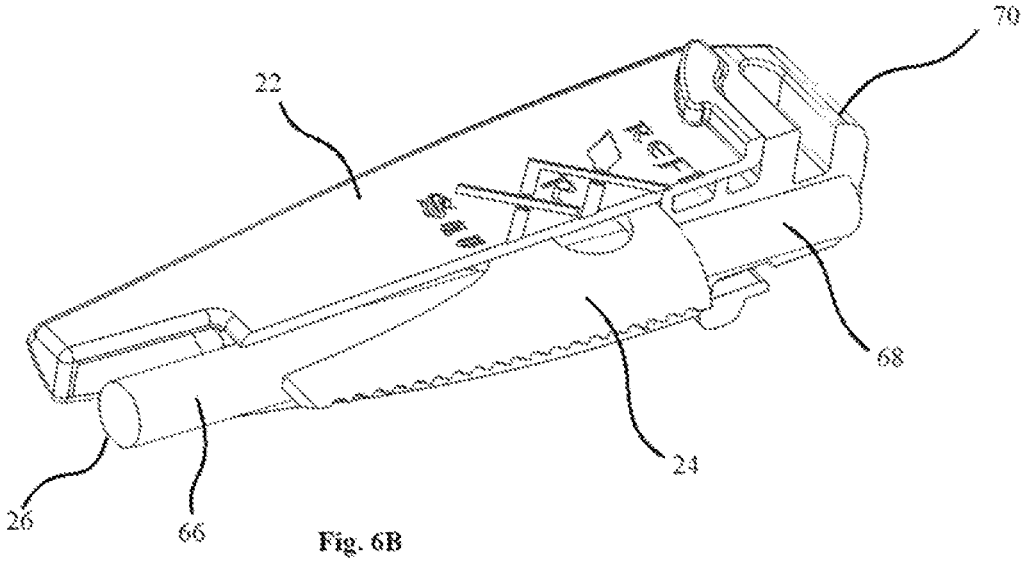

Now referring to FIGS. 6A and 6B, there is shown partial sectional views of the fire starter kit 20 where there is a section of the main body 22. Further, the cap 70 is shown in a sectional view. It can be seen that the scraper 24 fits in this form in the longitudinally forward area within the main body 22, the striker portion 66 of the combustion rod 26 positioned therein the vertically (not axis system 10 in FIG. 1). In a preferred form, the striker portion 66 extends therethrough the main body 22 to occupy space within the pistol where the entire fire starter kit will be housed. In other forms, of course, the striker portion 66 may be so much shorter and fit entirely within the storage compartment 38 of the main body 22 potentially making the storage compartment 38 substantially hermetically sealed and hence waterproof to prevent contacts therein getting wet. As for the shown in FIGS. 6A and 6B, the base portion 68 of the combustion rod 26 is such that the conventionally available and the combustion rod 66 may be press fit or fit with an adhesive within the cap 70. As noted above, the cap 70 with a low durometer material will it will fit within the main body 22 and further provides a good grip to grasp when striking the striker portion 66 of the combustion rod 26 with the scraper 24 to start a spark. Further, FIGS. 7A and 7B show partial cut-away views of firearm 100 where the fire starter kit 20 is conveniently housed therein.

Figure 15:
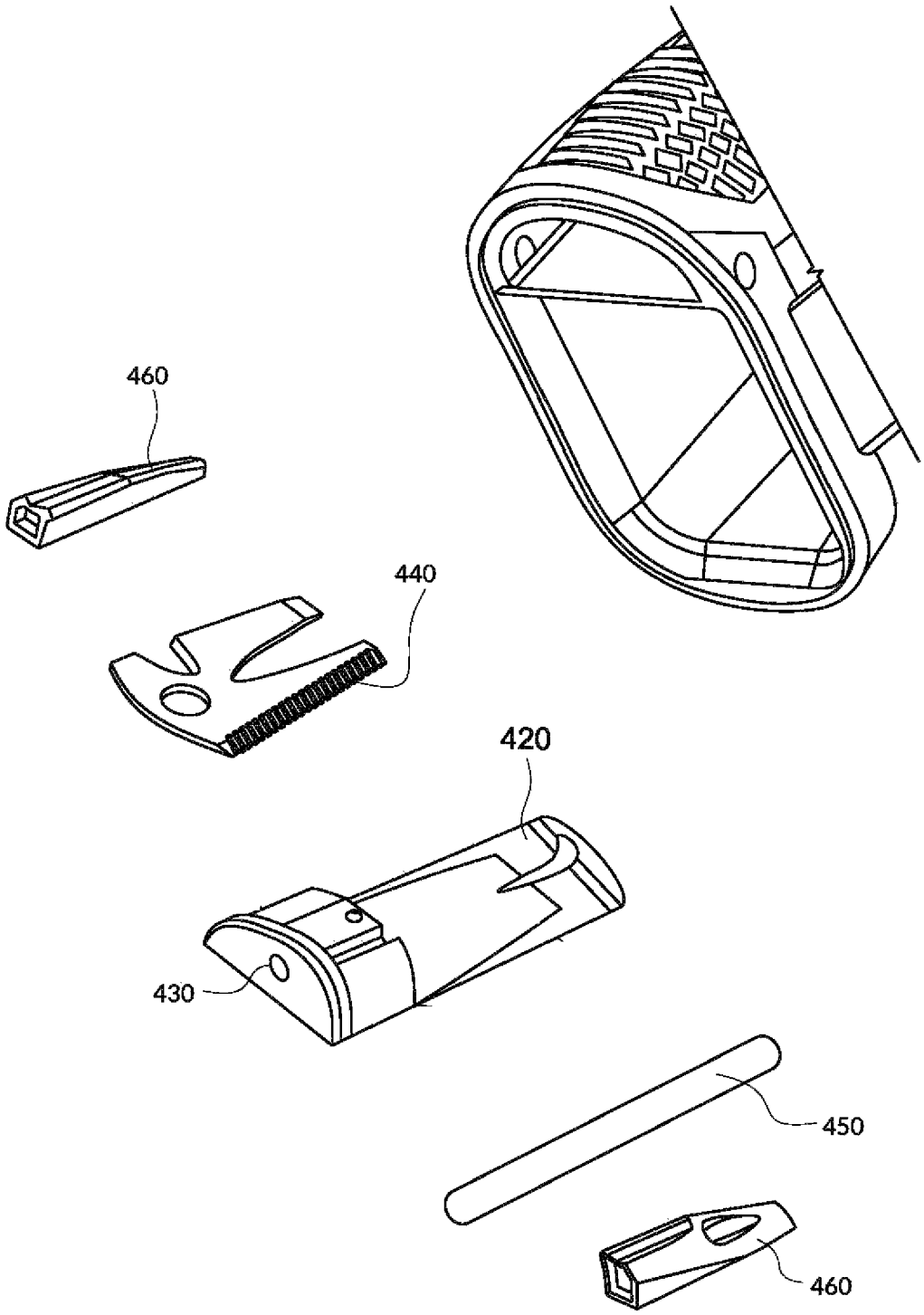
FIG. 15 illustrates an exploded view of a fire starter kit, in accordance with another exemplary embodiment of the present disclosure.

In another aspect, as illustrated in FIG. 15 the present disclosure provides another fire starter kit 400. The fire starter kit 400 includes a frame 420, a scratcher 440, a sparking road 450, at least one fuel reservoir 460.

Figure 16:
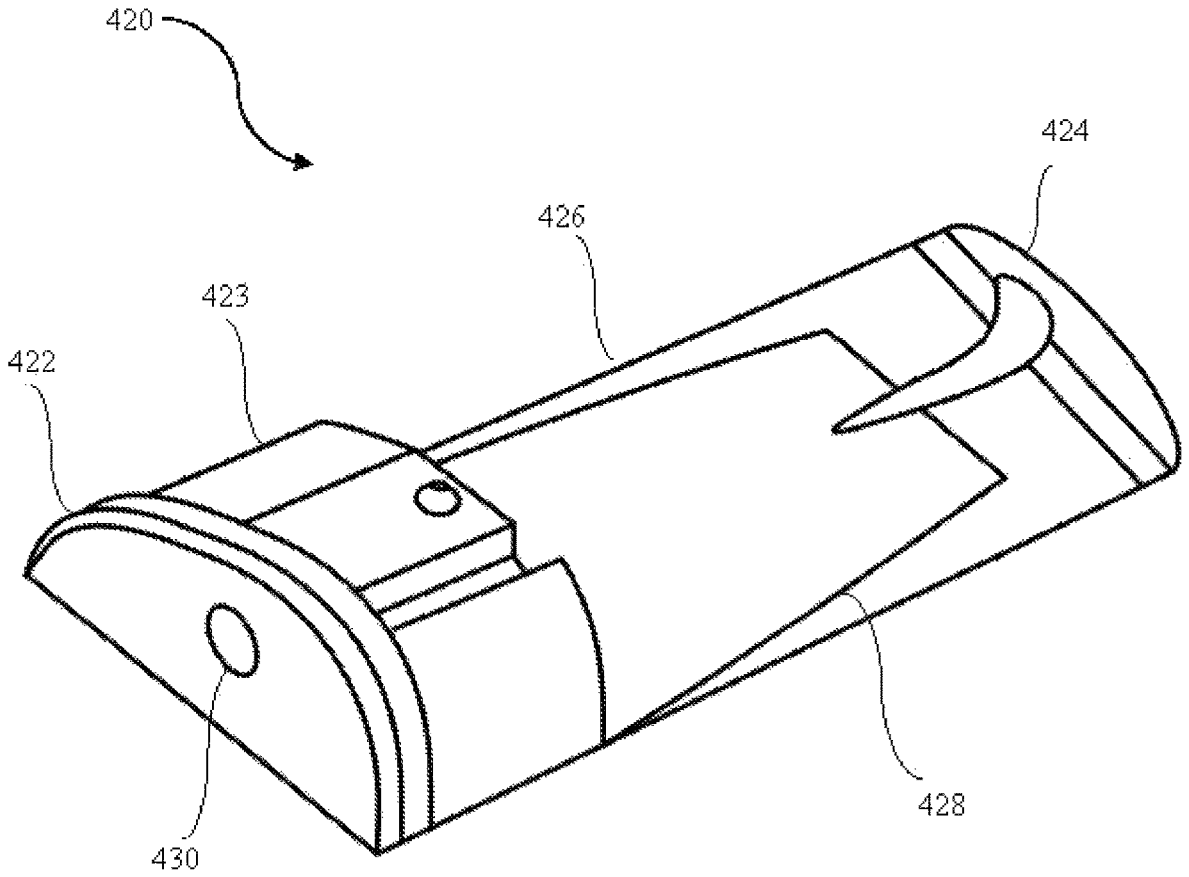
FIG. 16 illustrates a perspective view of the frame of the fire starter kit, in accordance with an exemplary embodiment of the present disclosure.

As illustrated in FIG. 15 & FIG. 16, the Frame 420 is having a first end 422, a second end 424, a middle region 426, a recess 428 provided on the middle region 426, and a first slot 430 provided along the first end 422, the second end 424 and partially through the middle region 426. The first end 422 of the frame further comprises a grip portion 423 that partially fits in the gun handle 410 to hermetically seal the fire starter kit into the gun handle 410, the grip portion 423 provides grip for holding and manipulating the fire starter kit 400. The frame 420 is made of a semi-flexible lightweight material selected from vulcanized rubber, natural rubber, low durometer rubber, or compressible plastics. In a preferred embodiment, the frame 420 is made of low durometer rubber. In another embodiment, the frame is made of a lightweight rigid material selected from thermosetting plastic, carbon fibre, or aluminium.

In an exemplary embodiment, the material used for making the frame is carbon fiber. The carbon fiber frame is lightweight and does not affect the weight distribution of the handle of the firearm in which the fire starter kid is kept. The frame 420 requires lesser material for large-scale production as compared to the fire starter kits known in the prior arts that utilize an enclosed body to prepare the fire starter kit.

Figure 17:
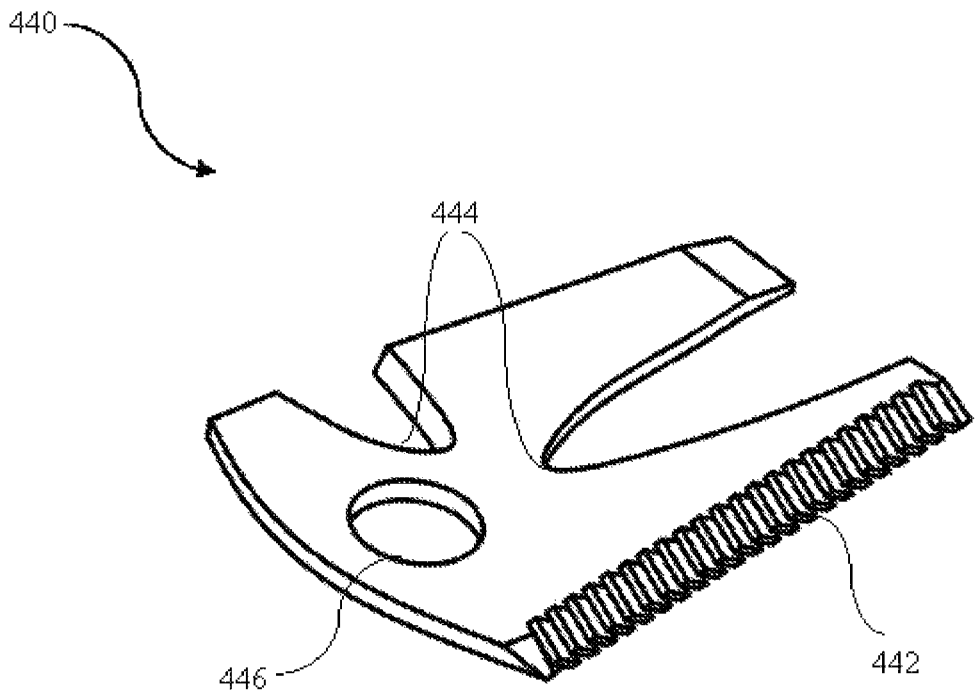
FIG. 17 illustrates a perspective view of the frame of the fire starter kit, in accordance with an exemplary embodiment of the present disclosure.

As illustrated in FIG. 15 & FIG. 17, the scratcher 440 is removably mounted in the recess, wherein the scratcher is having at least one first blade 442 provided with a plurality of tooths. In an embodiment, the scratcher 440 further includes at least one U-shaped slotted blade 444 and at least one circular slot 446. In a preferred embodiment, two U-shaped slotted blades 444 are present. The material of the Scratcher 440 is selected from aluminium, cast iron, or steel.

The sparking rod 450 is removably mounted within the first slot 430, wherein the sparking rod 450 is configured to produce sparks when scratched with the scratcher 440. The material of the sparking rod 450 is selected from iron, iron oxide, titanium, or white phosphorus. In a preferred embodiment, the material of the sparking rod is iron oxide, and the material of the scratcher is aluminium. On scratching the aluminium scratcher on the sparking rod of iron oxide forms high-temperature sparks due to thermite reaction.

The fuel reservoir 460 is removably mounted over the sparking rod 450 and the scratcher 440. The fuel reservoir 460 has a fibrous material with a fuel hermetically sealed in a packing. The fuel is selected from a mixture of petroleum jelly and beeswax that produces flexibility in the resulting fuel and maintains structural integrity without breaking and fissuring. wherein the fuel is having petroleum jelly in an amount in the range of 10 wt. % to 50 wt. %, and the beeswax in an amount in the range of 60 wt. % to 90 wt. %. In a preferred embodiment, the fuel is having the petroleum jelly in an amount in the range of 20 wt. % to 35 wt. %, and the beeswax is in an amount in the range of 65 wt. % to 80 wt. %. The fibrous material is selected from cotton, jute, timber or wood dust. In a preferred embodiment, the fibrous material is cotton that homogenizes with the fuel. As the cotton is hermetically sealed in the fuel reservoir, this provides a longer self-life to the fire starter kit of the present disclosure over the kits known in the prior arts wherein the cotton is stored loosely.

In another aspect, the present disclosure provides a method for starting a fire. The first step of the method is retrieving a fire starter kit 400 from a handle 410 of a firearm by pulling a frame 420 of the fire starter kit 400. In the second step of the method is dismantling the fire starter kit 400 to separate the individual components of the fire starter kit 400. The third step of the method is fixing a sparking rod 450 in the first slot 430 of frame 420. The fourth step of the method is exposing the fibrous material of a fuel reservoir 460 by twisting or cutting the fuel reservoir 460. The fifth step of the method is holding the frame 420 fitted with the sparking road 450 in front of the exposed fibrous material of the fuel reservoir 460. The sixth step of the method is creating a spark by scratching the sparking rod 450 with a scratcher 440 of sufficient temperature to ignite the fibrous material.

In an experiment, an aluminium scratcher is used with an iron oxide sparking rod. The fuel used was a composition of 30 wt. % petroleum jelly with 70 wt. % paraffin wax. The fibrous material used in the fuel reservoir was cotton. The fuel reservoir was bent and torn to expose fibers of cotton which are highly flammable expose in a great amount of surface area and took a spark immediately to burn the substrate petroleum product therearound intermixed therewith to make a sustainable flame. Experimentation has shown that the flame lasted up to four minutes with an approximate average of about three minutes and twenty seconds to three minutes and thirty seconds. However, the end-user can adjust the amount of exposed wax and the size of the flame similar to exposing how much cotton to expose to adjust the thermal output and hence the burn rate when starting a fire.

The fire starter kit 400 of the present disclosure is lightweight, easy and economical to manufacture, has a longer shelf life and provides self-sustainable fire for longer durations of 3-5 minutes.

The foregoing descriptions of specific embodiments of the present disclosure have been presented for purposes of illustration and description. They are not intended to be exhaustive or to limit the present disclosure to the precise forms disclosed, and obviously, many modifications and variations are possible in light of the above teaching. The embodiments were chosen and described in order to best explain the principles of the present disclosure and its practical application, to thereby enabling others skilled in the art to best utilize the present disclosure and various embodiments with various modifications as are suited to the particular use contemplated. It is understood that various omissions and substitutions of equivalents are contemplated as circumstances may suggest or render expedient, but such are intended to cover the application or implementation without departing from the spirit or scope of the present disclosure.

REFERENCE NUMERALS:

| | | |
|---|---|---|
| 20 | — | Fire starter kit |
| 10 | — | Axis system |
| 12 | — | Vertical axis |
| 14 | — | Lateral axis |
| 16 | — | Longitudinal axis |
| 22 | — | Main body |
| 24 | — | Scraper |
| 26 | — | Combustion road |
| 28 | — | First Fuel packet |
| 30 | — | Second fuel packet |
| 32 | — | Cotton module |
| 34 | — | External surface of main body 22 |
| 36 | — | Internal surface of main body 22 |
| 38 | — | Storage compartment |
| 40 | — | Lateral width of compartment 38 |
| 44 | — | Knife edge |
| 44' | — | Separation |
| 46 | — | Grip region |
| 48 | — | Flat screwdriver area |
| 50 | — | Hole |
| 54, 56 | — | Base ends |
| 60 | — | Straight edge |
| 66 | — | Striker position |
| 68 | — | Base portion |
| 70 | — | Cap |
| 72 | — | Sealing edge |
| 72', 72" | — | First and second sealing edges |
| 80 | — | Rearward surface |
| 82 | — | Region |
| 82' | — | Indentation on region 82 |
| 84 | — | Extension |
| 86 | — | Services |
| 100 | — | Firearm |
| 102 | — | Grip attachment |
| 104 | — | Rearward cavity |
| 400 | — | Fire starter kit |
| 410 | — | Gun handle |
| 420 | — | Frame |
| 422 | — | First end |
| 423 | — | Grip portion |
| 424 | — | Second end |
| 426 | — | Middle region |
| 428 | — | Recess |
| 430 | — | First slot |
| 440 | — | Scratcher |
| 442 | — | First blade |
| 444 | — | U-shaped blade |
| 446 | — | Circular slot |
| 450 | — | Sparking rod |
| 460 | — | Fuel reservoir |

What is claimed is:

1. A fire starter kit adapted to fit into a gun handle, comprising:

a frame having a first end, a second end, a middle region, a recess provided on the middle region, and a first slot provided along the first end, the second end and partially through the middle region;

a scratcher removably mounted in the recess, wherein the scratcher is having at least one blade;

a sparking rod removably mounted within the first slot, wherein the sparking rod is configured to produce sparks when scratched with the scratcher; and at least one fuel reservoir removably mounted over the sparking rod and the scratcher, wherein the at least one fuel reservoir has a fibrous material with a fuel hermetically sealed in a packing;

wherein the fuel is selected from a mixture of petroleum jelly and beeswax that produces flexibility in the resulting fuel and maintains structural integrity without breaking and fissuring.

2. The fire starter kit as claimed in claim 1, wherein the first end of the frame further comprises a grip portion that partially fits in the gun handle to hermetically seal the fire starter kit into the gun handle, the grip portion providing a grip for holding and manipulating the fire starter kit.

3. The fire starter kit as claimed in claim 1, wherein the frame is made of a semi-flexible lightweight material selected from vulcanized rubber, natural rubber, low durometer rubber, or compressible plastics.

4. The fire starter kit as claimed in claim 3, wherein the frame is made of low durometer rubber.

5. The fire starter kit as claimed in claim 1, wherein the frame is made of a lightweight rigid material selected from thermosetting plastic, carbon fibre, or aluminium.

6. The fire starter kit as claimed in claim 1, wherein the scratcher further comprises:

at least one U-shaped slotted blade; and at least one circular slot.

7. The fire starter kit as claimed in claim 1, wherein the material of the scratcher is selected from aluminium, cast iron, or steel.

8. The fire starter kit as claimed in claim 1, wherein the material of the sparking rod is selected from iron, titanium, or white phosphorus.

9. The fire starter kit as claimed in claim 1, wherein the fuel comprises:

the petroleum jelly is in an amount in the range of 10 wt. % to 50 wt. %; and the beeswax is in an amount in the range of 60 wt. % to 90 wt. %.

10. The fire starter kit as claimed in claim 9, wherein:

the petroleum jelly is in an amount in the range of 20 wt. % to 35 wt. %; and the beeswax is in an amount in the range of 65 wt. % to 80 wt. %.

11. The fire starter kit as claimed in claim 1, wherein the fibrous material is selected from cotton, jute, timber or wood dust.

12. The fire starter kit as claimed in claim 11, wherein the fibrous material is cotton that homogenizes with the fuel.

13. The fire starter kit as claimed in claim 1, wherein the fuel is a mixture of petroleum jelly and magnesium shavings.

14. A method for starting a fire comprising the steps of:

retrieving a fire starter kit from a handle of a firearm by pulling a frame of the fire starter kit;

dismantling the fire starter kit;

fixing a sparking rod in a first slot of the frame;

exposing fibrous material of at least one fuel reservoir by twisting or cutting the fuel reservoir;

wherein the at least one fuel reservoir includes a fuel hermetically sealed in a packing;

wherein the fuel is selected from a mixture of petroleum jelly and beeswax that produces flexibility in the resulting fuel and maintains structural integrity without breaking and fissuring;

holding the frame fitted with the sparking road in front of the exposed fibrous material of the reservoir; and creating a spark by scratching the sparking rod with a scratcher of sufficient temperature to ignite the fibrous material.

* * * * *